US005847347A

United States Patent [19]

Schwarze et al.

[11] Patent Number: 5,847,347

[45] Date of Patent: Dec. 8, 1998

[54] VACUUM INTERRUPTER

[75] Inventors: Wolfgang Schwarze, Berlin; Jörg Kusserow, Neuenhagen; Klaus Oberndörfer, Berlin, all of Germany

[73] Assignee: Siemens Aktiengesellschaft, München, Germany

[21] Appl. No.: 913,926

[22] PCT Filed: Mar. 8, 1996

[86] PCT No.: PCT/DE96/00467

§ 371 Date: Feb. 2, 1998

§ 102(e) Date: Feb. 2, 1998

[87] PCT Pub. No.: WO96/29718

PCT Pub. Date: Sep. 26, 1996

[30] Foreign Application Priority Data

Mar. 17, 1995 [DE] Germany ..... 195 10 850.7

[51] Int. Cl.[6] ..... H01H 33/66

[52] U.S. Cl. ..... 218/139; 218/134; 218/155

[58] Field of Search ..... 218/118–123, 134–139, 218/155

[56] References Cited

U.S. PATENT DOCUMENTS

| | | | |
|---|---|---|---|
| 3,369,094 | 2/1968 | Langberg et al. | 200/140 |
| 4,431,885 | 2/1984 | Sakuma et al. | 200/144 B |
| 4,614,850 | 9/1986 | Kuhl | 200/144 B |
| 4,672,156 | 6/1987 | Basnett | 200/144 B |
| 4,746,777 | 5/1988 | Bialkowski et al. | 200/144 B |
| 5,206,616 | 4/1993 | Stegmuller | 335/126 |
| 5,315,081 | 5/1994 | Hartmann | 200/144 B |

FOREIGN PATENT DOCUMENTS

| | | | |
|---|---|---|---|
| 0 040 933 | 12/1981 | European Pat. Off. | H01H 33/66 |
| 0 335 114 | 10/1989 | European Pat. Off. | H01H 33/66 |
| 0 419 940 | 4/1991 | European Pat. Off. | H01H 11/00 |
| 0 563 830 | 10/1993 | European Pat. Off. | H01H 33/66 |
| 27 54 547 | 6/1978 | Germany | H01H 33/66 |
| 33 43 918 | 6/1985 | Germany | H01H 33/66 |
| 37 09 585 | 10/1987 | Germany | H01H 33/66 |
| 39 31 774 | 4/1991 | Germany | H01H 11/00 |
| 43 20 910 | 9/1994 | Germany | C04B 37/02 |
| 1-132021 | 5/1989 | Japan | H01H 33/66 |
| 95/00459 | 1/1995 | WIPO | H01H 33/66 |

*Primary Examiner*—Michael A. Friedhofer
*Attorney, Agent, or Firm*—Kenyon & Kenyon

[57] ABSTRACT

To allow soldering of all parts of the housing including the tubular shield of a vacuum interrupter in a single operation, the metal cap (9) made of silver-plated copper enclosing the two contacts (1, 2) is provided with peripheral structuring (10, 11) on its rim (19) that is to be soldered to an end face of the hollow cylindrical insulator (12). At its flange-like rim (17), the tubular shield (16) is in contact with the same end face of the insulator (12) over spacer knobs (20) distributed around its circumference.

5 Claims, 1 Drawing Sheet

VACUUM INTERRUPTER

FIELD OF THE INVENTION

The present invention relates to the field of electric switches, specifically a vacuum interrupter that can be used as a switching element in low-voltage contactors.

BACKGROUND INFORMATION

A known vacuum interrupter for low-voltage contactors comprises essentially a two-pole contact arrangement and a vacuum-tight housing enclosing this contact arrangement, with the housing being formed by a metal cap, a hollow cylindrical ceramic insulator and bellows. The metal cap is soldered to the current conducting pin of the stationary contact and to the insulator at the end face, and furthermore, the bellows are soldered to the insulator at the end face and to a ring flange on the current conducting pin of the movable contact at the other end. To protect the inside surface of the ceramic insulator of this known vacuum interrupter from metal vapor deposition and thus guarantee the internal insulation strength of the vacuum interrupter and also protect the bellows from metal vapor deposition, the inside diameter of the ceramic insulator surrounding the current conducting pin of the stationary contact is designed to be as small as possible. This measure does not, however, completely prevent metal vapor deposition on the inside surface of the ceramic insulator (See German Patent No. A1 37 09 585 and U.S. Pat. No. 4,672,156).

With another known vacuum interrupter of this type, a flange is first provided on the end face of the ceramic insulator facing the bellows, where it is soldered to the bellows and is butt soldered to the end face of the ceramic insulator with a short tubular piece. A gap of a predetermined length is created between the end face of the ceramic insulator and the flange with the help of the short tubular piece. Since the end face of the ceramic insulator is not metal-plated in the area of this gap, the end face of the ceramic insulator facing away from the contacts ensures the internal dielectric strength of the vacuum interrupter. Special shielding for the ceramic insulator can be omitted (See European Patent No. A1 0 563 830 and U.S. Pat. No. 5,315,081).

With another known vacuum interrupter for low-voltage contactors, a tubular shield, with a rim that widens to a cap at one end, is provided for the ring-shaped ceramic insulator. This rim is soldered to a ring attachment which is in turn soldered to the end face of the ceramic insulator facing the two contacts. Several soldering operations are necessary to manufacture this vacuum interrupter (See German Patent No. 33 43 918 A1 and U.S. Pat. No. 4,614,850).

It is also known that in manufacturing vacuum interrupters, the end of the bellows can be soldered to the end of a ceramic part by a tubular piece (European Patent 0 40 933 A1) and for the housing, cap-like parts made of copper and electroplated with silver can be used, so it is not necessary to use a soldering ring for soldering to a ceramic part or a metal part (See Published International Application No. WO 95/00459).

SUMMARY OF THE INVENTION

The present invention is directed to a vacuum interrupter with a two-pole contact arrangement and a housing enclosing the contact arrangement. The housing comprises a metal cap soldered to the current conducting pin of the stationary contact and surrounds both the stationary contact and the movable contact, a bellows, as well as a hollow cylindrical insulator soldered to the metal cap at the end face. The bellows is soldered to both the insulator at the end and a ring flange on the current conducting pin of the movable contact. An object of the present invention is to provide effective shielding of the insulator, while allowing a simple method of manufacturing the vacuum interrupter, preferably with a single soldering operation.

The aforementioned object is achieved in accordance with the present invention by.

This object is achieved according to this invention by providing the insulator with a tubular shield which is in turn provided with a flange-like rim at one end and is in contact with the end face of the insulator facing the contacts by means of spacer knobs peripherally distributed around the rim, and on the rim of the metal cap soldered to the insulator, the cap is peripherally provided with structuring in the form of undulations or teeth with a wave or tooth height of 0.2 to 0.6 mm, the metal cap being made of copper and plated with silver for the purpose of soldering.

With such a vacuum interrupter design, the metal cap, ceramic insulator and shield can be soldered together in one operation, with this soldering being performed as sealing soldering. The structuring of the rim of the metal cap forms slit-like orifices through which the vacuum interrupter can be degassed before the soldering operation. On reaching the soldering temperature, enough solder is formed from the silver layer on the metal cap and the material of the metal cap to also form a vacuum-tight seal over the slit-like orifices.

If the vacuum interrupter is properly designed, the other soldering operations for vacuum-tight connection of the bellows to the insulator and the movable current conducting pin, and for connecting the metal cap to the stationary current conducting pin can be performed simultaneously with sealing soldering if the bellows sit flush against both the insulator and the ring flange of the movable current conducting pin by means of tubular pieces and if the stationary current conducting pin is in contact with the metal cap on the outside by means of a ring flange. A conical design of the movable current conducting pin in the area of the bellows makes it possible to center (on the soldered joint) the soldering ring required for soldering the bellows to the ring flange of the movable current conducting pin when inserting the various parts of the vacuum interrupter into the solder form. It is expedient to use a ring-shaped soldering foil for soldering the bellows to the ceramic insulator, while the silver plating on the metal cap serves to solder the metal cap to the stationary current conducting pin. To guarantee the required centering of the tubular shield inside the ceramic insulator in allocating the various parts of the vacuum interrupter inside a solder form, the tubular shield may also have an enlarged diameter for a length of approximately 3 mm in the transition area to the flange-like rim.

DETAILED DESCRIPTION

Figure 1:
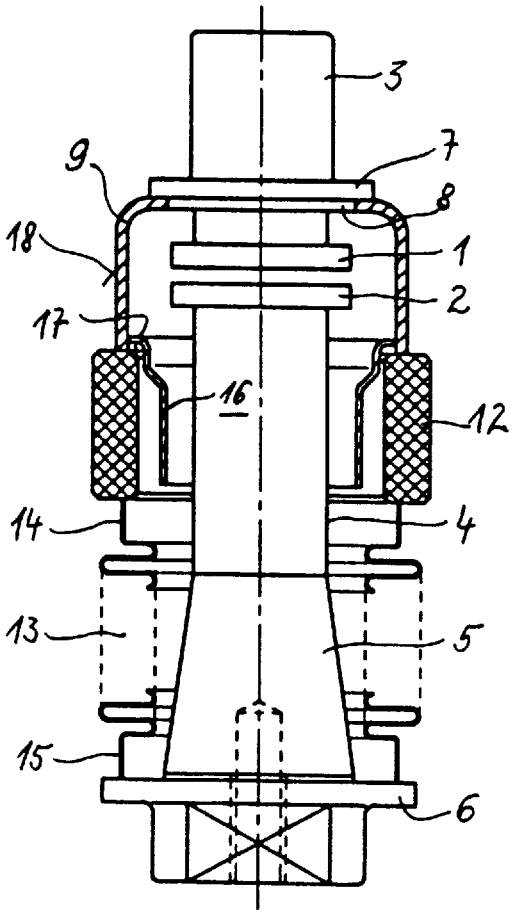
FIG. 1 shows a longitudinal section view of a vacuum interrupter.

FIG. 1 shows a vacuum interrupter having two contacts 1 and 2, one of which is arranged on the end of a stationary current conducting pin 3 and the other of which is arranged on the end of a movable current conducting pin 4. The contact arrangement is enclosed by a housing consisting of metal cap 9, hollow cylindrical ceramic insulator 12 and bellows 13. Metal cap 9 encloses the contact area of two contacts 1 and 2, and ceramic insulator 12 and bellows 13 enclose current conducting pin 4 of movable contact 2. Stationary current conducting pin 3 has a ring flange 7 and is in contact with metal cap 9 on the outside, with centering guaranteed by a centering shoulder 8.

Metal cap 9 is made of copper and plated with silver 18.

Metal cap 9 sits with its rim flush on an end face of hollow cylindrical ceramic insulator 12 whose other end face is in contact with a tubular piece 14 of bellows 13. At the other end, bellows 13 sit with another tubular piece 15 on a ring flange 6 of movable current conducting pin 4. Current conducting pin 4 is conical in design for a longitudinal section 5 which is enclosed by bellows 13.

Figure 2:
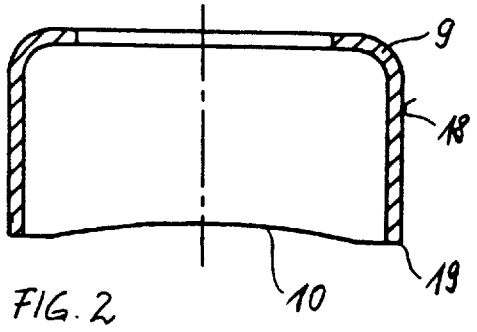
FIG. 2 shows a metal cap used as part of the housing of the vacuum interrupter having a rim structured with undulations.
Figure 3:
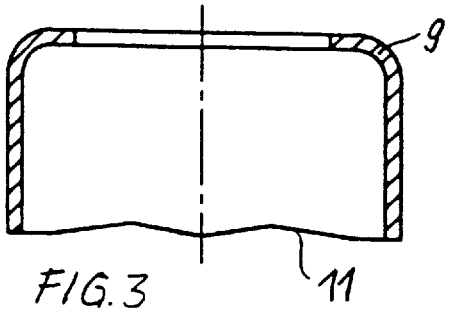
FIG. 3 shows a metal cap used as part of the housing of the vacuum interrupter having a rim structured with teeth.
Figure 4:
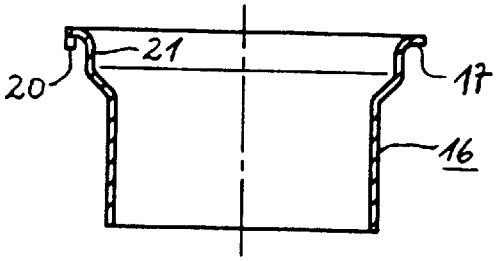
FIG. 4 shows a shield for an insulator arranged inside the vacuum interrupter.

By providing a soldering ring for tubular piece 15 of the bellows and a ring-shaped soldering foil for tubular piece 14 of the bellows, all the parts of the vacuum interrupter can be soldered in a single operation. To perform this soldering as sealing soldering, metal cap 9 according to FIGS. 2 and 3 is provided at its rim with structuring, which may be in the form of undulations 10 according to FIG. 2 or in the form of teeth 11 according to FIG. 3, where the height of the waves or teeth is preferably approximately 0.3 mm.

To protect the inside surface of ceramic insulator 12, a tubular shield 16 having a flange-like rim 17 at its end is also provided for the vacuum interrupter illustrated in FIG. 1. At this rim 17, the shield is in contact with the same end face of ceramic insulator 12 on which metal cap 9 also rests. To guarantee free access to the vent slots created by the structuring of the rim of the cap, flange-like rim 17 of shield 16 is provided with indentations in the form of spacer knobs 20 that lift shield 16 by approx. 0.5 to 1 mm with respect to the end face of ceramic insulator 12. For centering of shield 16 inside ceramic insulator 12, the flange-like tube may have an enlarged diameter for an approximately 3 mm-long longitudinal section 21 directly following flange-like rim 17.

In soldering the various components of the vacuum interrupter, shield 16 is also included in this soldering process, resulting in soldering to both metal cap 9 and end face of ceramic insulator 12.

What is claimed is:

1. A vacuum interrupter comprising:

a two-pole contact arrangement including a movable contact and a stationary contact, each of the contacts having a current conducting pin;

a housing enclosing the contact arrangement, the housing including a metal cap soldered to the current conducting pin of the stationary contact and surrounding both the stationary contact and the movable contact, wherein the metal cap includes copper plated with silver;

a hollow cylindrical insulator, the insulator being soldered to a rim of the metal cap at a first end of the insulator, wherein the rim of the metal cap is provided with at least one feature which is 0.2 to 0.6 mm high;

a bellows, a first end of the bellows being soldered to a second end of the insulator and a second end of the bellows being soldered to a ring flange on the current conducting pin of the movable contact; and a tubular shield, the tubular shield having a flange-like rim with a plurality of spacer knobs distributed around the rim, wherein the tubular shield is in contact with the first end of the insulator via the spacer knobs.

2. The vacuum interrupter of claim 1, wherein the at least one feature includes at least one of a tooth and an undulation.

3. The vacuum interrupter of claim 1, wherein the bellows is butt soldered to each of the insulator and the ring flange of the movable current conducting pin via respective tubular pieces, and wherein a portion of the movable current conducting pin which is adjacent to the bellows has a conical shape.

4. The vacuum interrupter of claim 1, wherein the current conducting pin of the stationary contact is soldered to the metal cap by a ring flange in contact with the metal cap on an outer surface of the metal cap.

5. The vacuum interrupter of claim 1, wherein a portion of the tubular shield adjacent to the flange-like rim has an enlarged diameter, said portion of the tubular shield having an axial length of approximately 3 mm.

* * * * *